United States Patent [19]

Proffer

[11] 4,313,686

[45] Feb. 2, 1982

[54] CONTAINER CAP WITH NECK ABUTTING RETRACTABLE APPLICATOR

[76] Inventor: Charles L. Proffer, P.O. Box 206, Gulfport, Miss. 39501

[21] Appl. No.: 118,569

[22] Filed: Feb. 4, 1980

[51] Int. Cl.[3] ..... A46B 11/00

[52] U.S. Cl. ..... 401/127; 401/129; 401/131; 401/6

[58] Field of Search ..... 401/118, 119, 127, 126, 401/129, 131, 6

[56] References Cited

U.S. PATENT DOCUMENTS

| | | | |
|---|---|---|---|
| 578,039 | 3/1897 | Kellogg | 401/127 |
| 817,694 | 4/1906 | Chaquette | 401/127 X |
| 2,538,447 | 1/1951 | Finney | 401/127 |
| 2,635,271 | 4/1953 | Auten | 401/127 X |
| 3,337,901 | 8/1967 | Schefer et al. | 401/129 |
| 3,741,666 | 6/1973 | Vasas et al. | 401/127 |

FOREIGN PATENT DOCUMENTS

| | | | |
|---|---|---|---|
| 442641 | 1/1968 | Switzerland | 401/126 |

*Primary Examiner*—Edward M. Coven

*Attorney, Agent, or Firm*—Harvey B. Jacobson

[57] ABSTRACT

A screw cap for a container equipped with a threaded neck is provided and the cap supports an applicator shank therefrom for limited axial shifting and rotation relative to the cap. The applicator shank is spring biased to a position of maximum extension relative to the open end of the cap and is equipped with an abutment disc for abutting the outer end of the associated container threaded neck for partially retracting the shank in response to threaded engagement of the cap with the container neck. The applicator shank is of an length to extend to the bottom of the container when the disc is abutted against the outer end of the container neck and the shank may be extended relative to the cap to a position with the abutment disc disposed slightly outwardly of the open end of the cap when the cap is disengaged from the container neck.

16 Claims, 8 Drawing Figures

FIG. 6
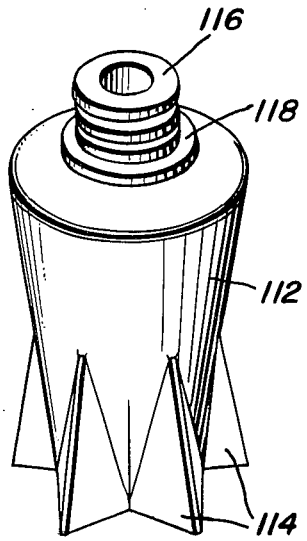
FIG. 7
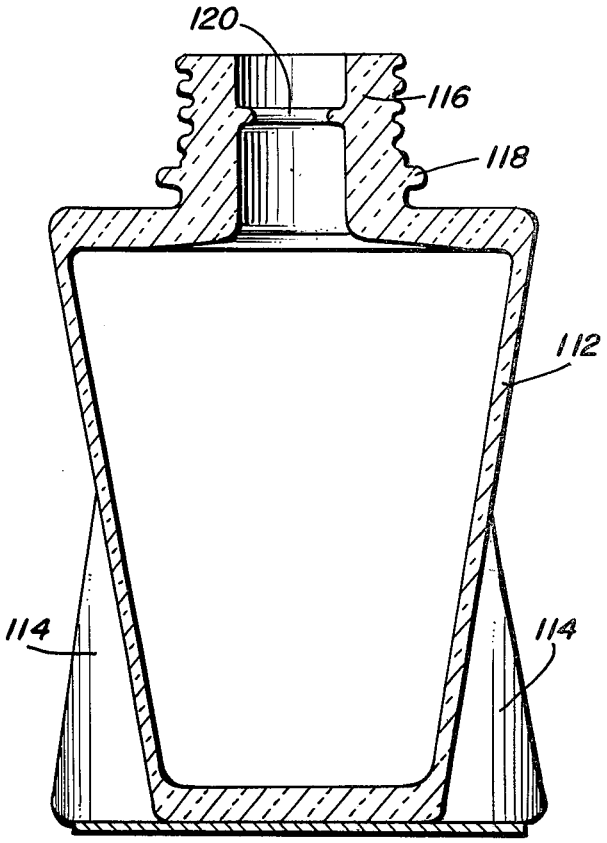
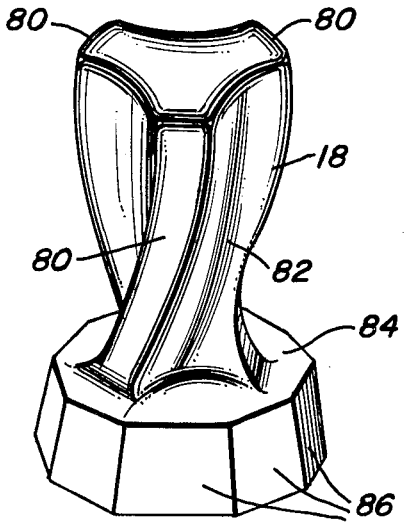
FIG. 8

CONTAINER CAP WITH NECK ABUTTING RETRACTABLE APPLICATOR

BACKGROUND OF THE INVENTION

Various liquid materials are marketed in containers equipped with threaded closure caps having elongated applicator shanks supported therefrom and most of these applicator shanks extend to the bottom of the interior of the container when the cap is fully threaded on the neck of the containers. However, when the cap is not threadedly engaged with the neck of the container but merely abutted against the outer end thereof, the applicator shank is not sufficiently long to reach to the bottom of the associated container. Accordingly, in order to position the applicator of an applicator equipped cap sufficiently into an associated container to reach the last bit of liquid within the container upon the latter having its contents almost completely depleted, it is necessary to screw the cap onto the neck of the container each time the applicator shank is to contact the liquid within the container. This, of course, is time consuming.

In addition, although container caps heretofore have been provided with reciprocally supported applicator shanks such as that disclosed in U.S. Pat. No. 3,337,901, these reciprocal applicator shanks, while accomplishing the desired effect of enabling the applicator shanks to withdraw the final amount of liquid from the bottoms of the associated containers, include generally radially outwardly projecting abutment discs carried thereby for abutting engagement with the outer ends of the associated container necks and the abutment discs are subject to being bonded to the outer end of the container necks by the drying of liquid materials thereon from within the associated containers. Accordingly, a need exists for a container cap reciprocally supported applicator shank including structure whereby any bonding of the container neck abutting disc on the container neck outer end may be freed upon initial loosening of the container cap.

The main object of this invention is to provide a screw cap for a container including a reciprocally supported applicator shank which may extend down to the bottom of the interior of the container both when the cap is screwed on a threaded neck of the container and when the cap is abutted against the outer end of the container neck, but with the applicator shank and cap including coacting structure releasably keying the shank and thus the disc of the shank to the cap for rotation therewith while loosening of the cap from a tightened position on the neck of the associated container.

Another object of this invention is to provide a container applicator cap constructed in a manner whereby an effective manual grip on the cap may be had by a person wishing to "break" the cap loose on the neck of an associated container upon initial loosening of the cap.

Another object of this invention is to provide a container structure whose external configuration facilitates an effective manual grip on the container.

A still further object of this invention is to provide a container and cap combination constructed in a manner whereby rolling of the combination while disposed on its side on a support surface will be effectively prevented.

An ancillary object of this invention is to provide a tool by which the applicator and cap body portion of the cap may be readily assembled.

A final object of this invention to be specifically enumerated herein is to provide a combined container and cap construction in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 6 is a perspective view of a modified form of container;

FIG. 7 is an enlarged vertical sectional view of the container illustrated in FIG. 6 taken substantially upon a plane passing through the central portion of the container; and FIG. 8 is a perspective view of the cap body portion of the instant invention.

DETAILED DESCRIPTION OF THE INVENTION

Figure 1:
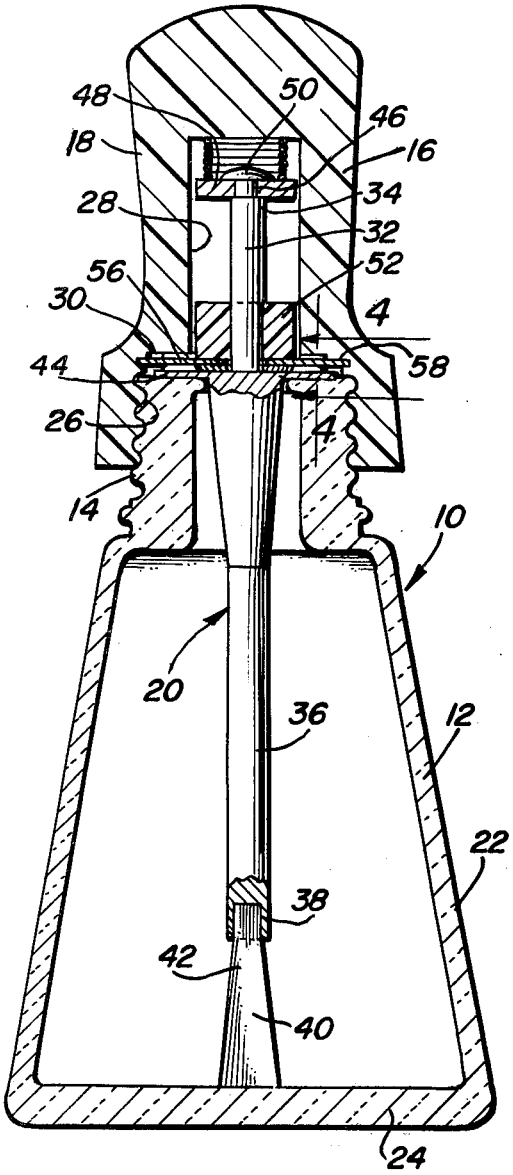
FIG. 1 is a central vertical sectional view taken substantially upon a plane passing through the center of a closure cap and container combination constructed in accordance with the present invention and with the closure cap in a fully closed position.

Referring now more specifically to the drawings, the numeral 10 generally designates a container and cap combination including a container 12 equipped with an externally threaded neck 14 and a cap 16 including a cap body 18 and an applicator assembly referred to in general by the reference numeral 20.

The container 12 is generally frusto-conical in configuration and includes upwardly convergent side walls 22 interconnected at their lower ends by a horizontal bottom wall 24. The upper ends of the side walls 22 support the externally threaded neck 14.

The cap body 18 includes a first lower downwardly opening threaded recess 26 formed therein and a second upper recess 28 therein opening downwardly into the upper end of the recess 26, a circumferential downwardly facing shoulder 30 being defined between the upper end of the recess 26 and the lower end of the recess 28.

The applicator assembly 20 includes an elongated applicator shank 32 including upper and lower end portions 34 and 36. The lower end portion 36 includes an endwise outwardly opening recess 38 in which a tuft 40 of applicator bristles 42 are anchored. The upper end portion 34 includes a radially outwardly projecting and circumferentially extending abutment disc 44 above which the shank 32 is diametrically reduced. The upper terminal end 46 of the shank 32 is further reduced and has an abutment washer 48 mounted thereon and secured in position by means of an enlarged portion 50.

A sleeve 52 is slidably disposed on the upper end portion 34 and a compression spring 54 is disposed within the recess 28 above the washer 48 and thereby biases the latter and the shank 32 downwardly relative to the cap body 18.

A locking disc 56 slidably receives the upper end portion 34 therethrough below the sleeve 52 and above the abutment disc 44 and the outer periphery of the locking disc 56 is seated in a circumferential inwardly opening groove 58 formed in the cap body 18 at the upper end of the first recess 26.

Figure 4:
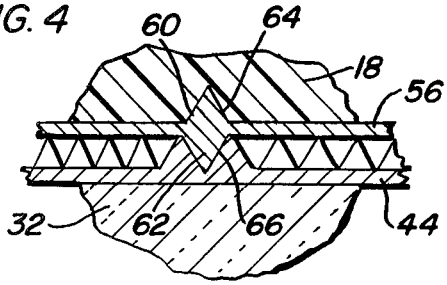
FIG. 4 is a fragmentary enlarged vertical sectional view taken substantially upon a plane indicated by the section line 4—4 of FIG. 1.

As may best be seen from FIG. 4 of the drawings, the upper and lower surfaces of the locking disc 56 include circumferentially spaced and generally radially extending ribs 60 and 62 and the shoulder 30 includes similar recesses 64 spaced about the lower end of the recess 28 while the upper surface of the abutment disc 44 includes corresponding recesses 66. Of course, the ribs 60 and 62 are receivable in the recesses 64 and 66 whereby the locking disc 56 may be locked relative to the cap body 18 against rotation relative thereto and the abutment disc 44 may be locked against rotation relative to the locking disc 56 when the abutment disc 44 has its upper side abutted against the lower side of the locking disc 56.

Figure 2:
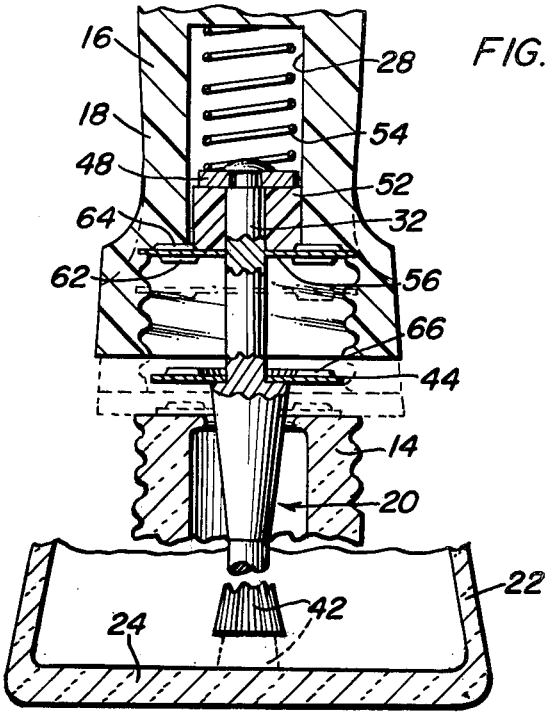
FIG. 2 is a fragmentary vertical sectional view similar to FIG. 1 but illustrating the closure cap in a disengaged position relative to the threaded neck of the container.

From FIG. 1 of the drawings, it may be seen that the bristles 42 substantially engage the upper surface of the bottom 24 when the cap 16 is fully threadedly engaged with the neck 14, and that the bristles 42 may also engage the upper surface of the bottom 24 when the lower open end of the cap body 28 is merely abutted against the open upper end of the neck 14. This is possible because the applicator shank 32 is biased downwardly relative to the cap body 18, when the latter is removed from the neck 14, by the spring 54. It will be noted from FIG. 2 of the drawings that the applicator shank 32 may be slightly extended from the open end of the cap body 18 to a position with the abutment disc 44 extended beyond the open end of the cap body 18.

Figure 5:
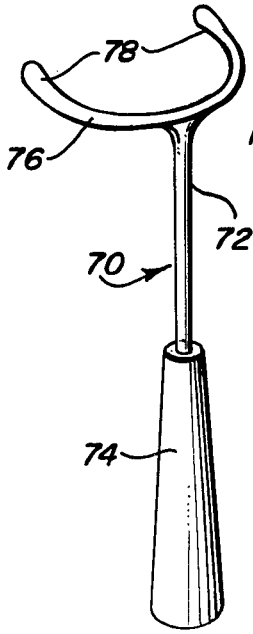
FIG. 5 is a perspective view of a tool utilized in assembling the applicator and cap body portions of the cap.

In FIG. 5 of the drawings is illustrated a tool referred to in general by the reference numeral 70 and the tool 70 includes an elongated shank 72 having a handle 74 on one end and a U-shaped thrust member 76 on its other end with the shank 72 joined to the thrust member 76 centrally intermediate the free ends of the legs 78 thereof.

Figure 3:
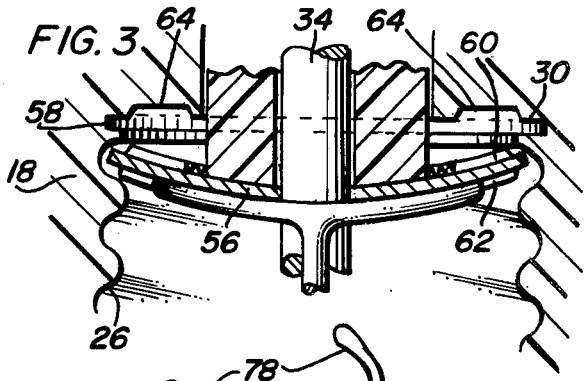
FIG. 3 is a fragmentary elevational view illustrating the manner in which the applicator and cap body components of the cap structure may be assembled.

When it is desired to assemble the applicator assembly 20 to the cap body 18, the thrust member 76 is engaged with the outer peripheral portion of the locking disc 56 in the manner illustrated in FIG. 3 of the drawings and forced upwardly relative to the central portion of the locking disc 56 in order that the latter may be made sufficiently bowed to be received within the groove 58. This, of course, is carried out while the applicator assembly 20 is fully assembled as to its component parts and the compression spring 54 is disposed within the second upper recess 28 above the washer 48.

With attention now invited more specifically to FIG. 8 of the drawings, it may be seen that the cap body 18 includes an upper portion having three transversely rounded ribs 80 defined thereon extending vertically therealong and projecting generally radially outwardly from the center portion of the cap. The ribs are slightly similarly twisted about the longitudinal axis of the body. The ribs 80 are carried by the upper portion 82 of the cap body 18 and the cap body 18 includes a lower portion 84 of truncated pyramidal shape and including relatively angulated circumferentially spaced flat surfaces 86. The surfaces 86 are disposed in planes tangent to the radial outermost surfaces of the upper end portions of the ribs 80. The surfaces 86 tend to prevent the combination 10 from rolling along a horizontal surface when the combination 10 is disposed on its side.

With attention now invited more specifically to FIGS. 6 and 7 of the drawings, there will be seen a second form of container 112 which is similar to the container 12 except that the container 112 is generally inverted truncated cone shaped and includes generally radially outwardly projecting and circumferentially spaced tabs 114 extending outwardly therefrom to facilitate manual gripping of the container 112. Further, the exterior of the neck 116 of the container 112 includes a lower radial outwardly projecting abutment ridge 118 and the interior of the neck 116 includes a radially inwardly projecting circumferential rib 120 upon which excess liquid supported from the bristles 42 may be wiped.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A screw cap and dispenser combination for reaching substantially completely to the bottom of the interior of an associated container, said combination including a cap body defining a first downwardly opening lower threaded recess therein for threadingly receiving a threaded container neck and a second upper applicator shank mounting recess within said cap body above said first recess and opening downwardly thereinto, an elongated upstanding dispenser shank including liquid pickup means on its lower end, mounting means mounting the upper end of said dispenser shank in said second recess for limited vertical shifting therein as well as rotation of said shank about its longitudinal axis relative to said cap body, said shank and cap body including coacting means operable to releasably key said shank to said cap body against rotation of said shank relative to said cap body responsive to movement of said shank upper end from its lower limit position toward its upper limit position, said applicator shank including a radially outwardly projecting abutment disc carried thereby for abutting with the outer end of a threaded container neck, said cap body including means defining an annular shoulder at the inner end of said first recess, said shank including a circumferential flange opposing and seated against said shoulder when said shank is in the upper limit position thereof, said coacting means including interfittingly engageable detent and projection means on said shoulder and flange when said shank is in said upper limit position.

2. The combination of claim 1 wherein said mounting means includes a washer mounted on said shank and a circumferential groove formed in said cap at the inner end of said first recess, said washer having its outer periphery seated in said groove.

3. The combination of claim 1 wherein said cap body includes an upper portion including three transversely rounded ribs extending vertically therealong and projecting outwardly therefrom, said ribs being slightly similarly twisted about said body.

4. The combination of claim 3 wherein said cap body includes a lower portion of truncated pyramidal shape, the relatively angulated sides of said lower portion being tangent to a circular zone including and containing the upper extremities of said ribs.

5. The combination of claim 1 including a container provided with a threaded upper neck with which said cap body may be threadedly engaged for closing said neck, said abutment disc being abuttingly engageable with the outer end of said neck for shifting said shank to said upper limit position responsive to said cap body being removably threaded on said neck.

6. The combination of claim 5 wherein said container includes a bottom having an upper inner surface, said applicator means being disposed at least closely adjacent said upper inner surface when said cap body is threaded on said neck and said shank is in its upper limit position and also at least closely adjacent said upper inner surface when said cap body is abutted against said neck, exclusive of threaded engagement therewith and said shank is in said lower limit position.

7. The combination of claim 6 wherein said container includes an interior which is truncated cone shaped.

8. The combination of claim 6 wherein said container includes an interior which is inverted truncated cone shaped with its major transverse dimension lowermost.

9. The combination of claim 8 wherein the lower portion of said container includes generally radially outwardly projecting and circumferentially spaced tabs extending longitudinally of said container.

10. The combination of claim 9 wherein said tabs are generally V-shaped in cross section with their apices facing radially outwardly of said container.

11. A screw cap and dispenser combination for reaching substantially completely to the bottom of the interior of an associated container, said combination including a cap body defining a first downwardly opening lower threaded recess therein for threadingly receiving a threaded container neck and a second upper applicator shank mounting recess within said cap body above said first recess and opening downwardly thereinto, an elongated upstanding dispenser shank including liquid pickup means on its lower end, mounting means mounting the upper end of said dispenser shank in said second recess for limited vertical shifting therein as well as rotation of said shank about its longitudinal axis relative to said cap body, said shank and cap body including coacting means operable to releasably key said shank to said cap body against rotation of said shank relative to said cap body responsive to movement of said shank upper end from its lower limit position toward its upper limit position, said applicator shank including a radially outwardly projecting abutment disc carried thereby for abutting with the outer end of a threaded container neck, said cap body including means defining an annular shoulder at the inner end of said first recess, said coacting means including generally radial corrugations formed in said shoulder, said shank including an integral circumferential flange opposing and seated against said shoulder when said shank is in and defining the latter's upper limit position, said coacting means also including generally radial corrugations on said circumferential flange opposing and interfitted with the first mentioned corrugations when said shank is in said upper limit position.

12. A screw cap and dispenser combination for reaching substantially completely to the bottom of the interior of an associated container, said combination including a cap body defining a first downwardly opening lower threaded recess therein for threadingly receiving a threaded container neck and a second upper applicator shank mounting recess within said cap body above said first recess and opening downwardly thereinto, an elongated upstanding dispenser shank including liquid pickup means on its lower end, mounting means mounting the upper end of said dispenser shank in said second recess for limited vertical shifting therein as well as rotation of said shank about its longitudinal axis relative to said cap body, said shank and cap body including coacting means operable to releasably key said shank to said cap body against rotation of said shank relative to said cap body responsive to movement of said shank upper end from its lower limit position toward its upper limit position, said applicator shank including a radially outwardly projecting abutment disc carried thereby for abutting with the outer end of a threaded container neck, a container provided with a threaded upper neck with which said cap body may be threadedly engaged for closing said neck, said abutment disc being abuttingly engageable with the outer end of said neck for shifting said shank to said upper limit position responsive to said cap body being removably threaded on said neck, said container including a bottom having an upper inner surface, said applicator means being disposed at least closely adjacent said upper inner surface when said cap body is threaded on said neck and said shank is in its upper limit position and also at least closely adjacent said upper inner surface when said cap body is abutted against said neck, exclusive of threaded engagement therewith and said shank is in said lower limit position, said cap body including means defining an annular shoulder at the inner end of said first recess, said coacting means including generally radial corrugations formed in said shoulder, said shank including an integral circumferential flange opposing and seated against said shoulder when said shank is in and defining the latter's upper limit position, said coacting means also including generally radial corrugations on said circumferential flange opposing and interfitted with the first mentioned corrugations when said shank is in said upper limit position.

13. The combination of claim 12 wherein said mounting means includes a locking disc slidably mounted on said shank and a circumferential groove formed in said cap at the inner end of said first recess, said locking disc having its outer periphery seated in said groove.

14. The combination of claim 13 wherein said cap body includes an upper portion including three transversely rounded ribs extending vertically therealong and projecting outwardly therefrom, said ribs being slightly similarly twisted about said body.

15. The combination of claim 14 wherein said cap body includes a lower portion of truncated pyramidal shape, the relatively angulated sides of said lower portion being tangent to a circular zone including and containing the upper extremities of said ribs.

16. The combination of claim 13 wherein said locking disc is flexive, and a disc installation tool including an elongated shank defining a handle on one end, the other end of said shank having a U-shaped pressure foot mounted thereon disposed in a plane generally normal to said shank and having an area of said foot centrally intermediate the free ends of the legs of said U-shaped foot anchored to said other shank end, said pressure foot being engageable with greater than 180° of said locking disc and receivable within said first recess for flexing said locking disc into a dished configuration to thereby reduce the effective diameter thereof and assist in snap-fitting the outer periphery of said locking disc into said groove.

* * * * *